United States Patent [19]

MacFee

[11] 4,324,033

[45] Apr. 13, 1982

[54] GAPPING SLIDE FASTENER ELEMENTS ON MEMBERS WOVEN IN TAPE EDGES

[75] Inventor: Norman W. MacFee, Conneaut Lake, Pa.

[73] Assignee: Talon, Inc., Meadville, Pa.

[21] Appl. No.: 175,097

[22] Filed: Aug. 4, 1980

[51] Int. Cl.[3] ..... B23P 19/04

[52] U.S. Cl. ..... 29/408

[58] Field of Search ..... 29/33.2, 408, 410, 426.4, 29/426.5, 766, 770; 83/921

[56] References Cited

U.S. PATENT DOCUMENTS

| | | | |
|---|---|---|---|
| 3,128,543 | 4/1964 | Fasciano | 29/408 |
| 3,225,430 | 12/1965 | Fasciano | 29/408 |
| 3,273,229 | 9/1966 | Taylor | 83/921 X |
| 3,456,328 | 7/1969 | Wasko | 29/408 |
| 3,540,090 | 11/1970 | Takamatsu | 29/408 X |
| 3,611,545 | 10/1971 | Takamatsu | 29/408 |
| 3,763,546 | 10/1973 | Perlman | 29/408 |
| 3,863,323 | 2/1975 | Takamatsu | 29/408 |
| 4,131,223 | 12/1978 | Aureli | 83/921 X |
| 4,232,438 | 11/1980 | Takahashi et al. | 29/408 |

*Primary Examiner*—Ervin M. Combs

*Attorney, Agent, or Firm*—O'Brien & Marks

[57] ABSTRACT

Slide fastening elements mounted on longitudinal connecting and supporting means woven in the edge of a supporting tape with pluralities of loops of weft thread segments passing around the connecting and supporting means between the fastening elements, are removed by cutting the connecting and supporting means on opposite sides of each fastening element of a group of the fastening elements to be removed, and pivoting the group of fastening elements and severed ends of the connecting and supporting means about an axis extending parallel the tape and spaced from the tape and the connecting and supporting means to pull the group of fastening elements and severed ends of the connecting means from the weft thread loops.

6 Claims, 12 Drawing Figures

GAPPING SLIDE FASTENER ELEMENTS ON MEMBERS WOVEN IN TAPE EDGES

TECHNICAL FIELD

The invention relates to methods and apparatus for removing fastening elements from sections of tapes in the manufacture of slide fasteners, and particularly, to removing elements which are mounted on longitudinal load carrying support members, such as cords, threads or the like, secured by weaving in edges of the tapes by loops of the tape weft thread passing over the support members between the fastening elements.

BACKGROUND ART

It has been previously suggested to remove elements mounted on longitudinal connecting and supporting members woven in the edges of tapes by cutting the members on both sides of each element to be removed and then pulling or removing the fastening elements and the severed ends of the connecting and supporting members from loops of weft thread which normally secure the members to the edges of the tapes. In one particular prior art technique, the fastening elements with the severed stubs of support members are removed by pulling the slide fastener tapes longitudinally between opposed biased blades engaging the elements to strip the fastening elements from the weft thread loops.

The prior art, as exemplified in U.S. Pat. Nos. 2,846,006, 3,273,229, 3,540,090, 3,611,545 and 4,131,223, also contains a number of apparatus and methods for removing other types of fastening elements from slide fasteners and/or cutting slide fasteners to length. Such apparatus and methods usually include techniques and facilities for positioning the elements relative to gapping or cutting facilities.

SUMMARY OF THE INVENTION

The invention is summarized in the gapping of a slide fastener stringer which includes a woven tape, a plurality of spaced fastening elements, and longitudinal connecting and supporting means joined with and extending between the fastening elements, the tape having pluralities of loops of weft thread segments passing around the connecting and supporting means, the gapping including the steps of cutting the connecting and supporting means on opposite sides of each fastening element of a group of fastening elements to be removed, and removing the group of fastening elements and severed ends of connecting and supporting means from between the loops of weft thread segments, the removing including pivoting the group of fastening elements and severed ends of the connecting and supporting means about an axis extending parallel to the tape and spaced from the tape and the connecting and supporting means.

An object of the invention is to provide improved and more efficient techniques for gapping a slide fastener stringer wherein the elements to be gapped are supported on longitudinal means woven in the edge of the stringer tape.

One advantage of the invention is that a pivotal movement to remove fastening elements can be imparted to the elements in a direction tangential to the direction of cutting of the connecting and supporting member or members to thus enable both the cutting and removal to be performed by a mechanism moving in a single direction with a single stroke.

Other objects, advantages and features of the invention will be apparent from the following description of the preferred embodiment taken in conjunction with the accompanying drawings.

DESCRIPTION OF THE PREFERRED EMBODIMENT

Figure 1:
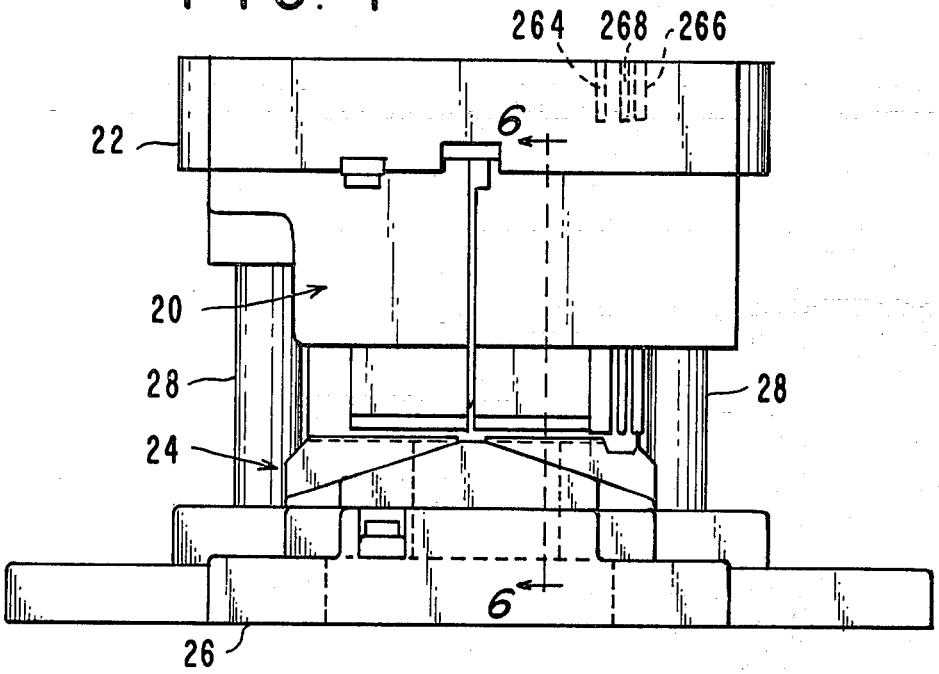
FIG. 1 is a front elevational view of a mechanism which may be used for gapping a slide fastener chain in accordance with the invention.
Figure 4:
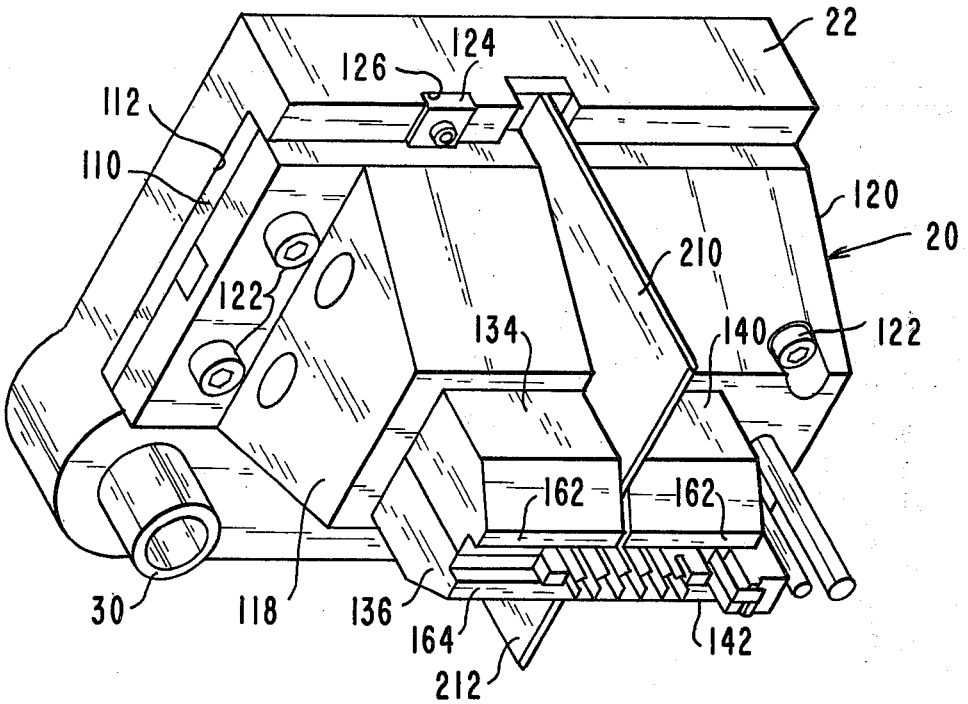
FIG. 4 is a perspective view taken from the bottom left front corner of an upper portion of the mechanism of FIG. 1 with pressure pads thereof shown partially raised.
Figure 5:
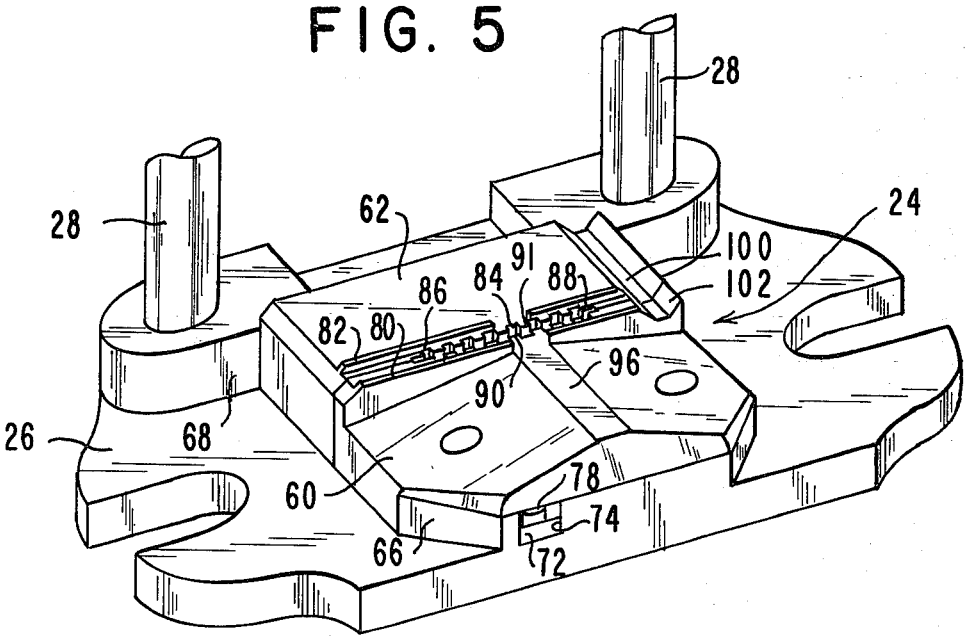
FIG. 5 is a perspective view taken from the upper left front corner of a lower portion of the mechanism of FIG. 1

As shown in FIGS. 1, 4 and 5, a mechanism suitable for employment in a conventional press for gapping and cutting continuous slide fastener chain includes a punch arrangement indicated generally at 20 mounted on an upper bolster 22 of the press apparatus and a die arrangement indicated generally at 24 mounted on a lower bolster 26 of the press apparatus. Leader shafts 28 are mounted on the rear side of the lower bolster 26 while bushings 30 are suitable mounted on the rear portion of the upper bolster 22 for sliding on the shafts 28 and guiding the upper bolster 22 relative to the lower bolster 26. The upper bolster 22 and lower bolster 26 are designed to be mounted in a conventional press mechanism.

Figure 2:
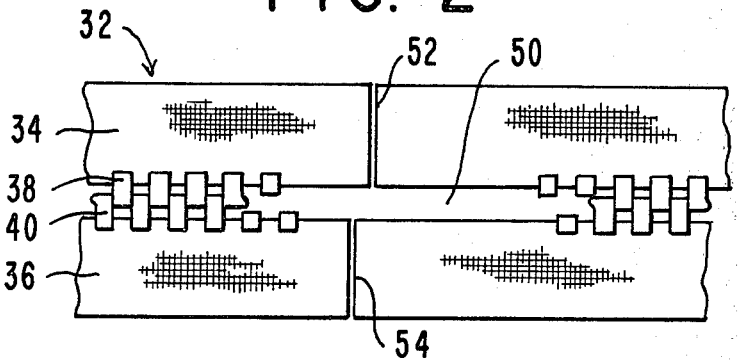
FIG. 2 is a plan view of a section of a slide fastener chain which has been gapped in accordance with the invention.
Figure 11:
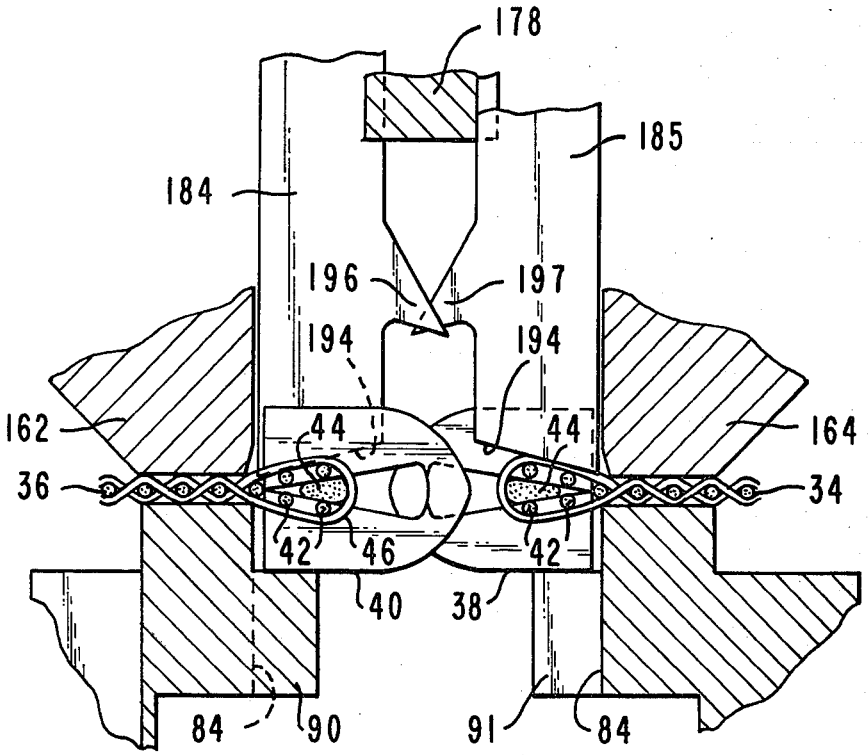
FIG. 11 is an enlarged section view of a portion of the mechanism of FIG. 6 illustrating a connecting-thread cutting step.

The punch arrangement 20 and the die arrangement 24 are designed to gap and cut a continuous slide fastener chain indicated generally at 32, FIG. 2, which has a pair of tapes 34 and 36 with rows of interlocking fastening elements 38 and 40 attached to the inner edges of the respective tapes 34 and 36. The tape 34 and elements 38 define one stringer of the slider fastener chain while the tape 36 and elements 40 define a second stringer of the slide fastener chain. The slide fastener chain is a woven type wherein the fastening elements 38 and 40 are mounted on longitudinal supporting and connecting means, such as cords, threads, etc., which are woven in the inner edge of the tapes 34 and 36 by weft thread loops of the tapes passing over the connecting and supporting means between the elements. Examples of this type of slide fastener chain are disclosed in U.S. Pat. Nos. 4,033,014, 4,084,296, 4,140,157, 4,157,603, and 4,171,556. By way of example, the connecting and supporting means is shown in FIG. 11 as pluralities of connecting threads 42 embedded in the leg portions of the respective fastening elements 38 and 40 and invested cords 44 held between leg portions of the respective fastening elements 38 and 40. Weft thread loops 46 pass around the connecting threads 42 and the invested cord 44 between each pair of adjacent fastening elements to secure the respective connecting and supporting means and elements 38 and 40 to the tapes 34 and 36. The punch arrangement 20 and die arrangement 24 form a gap 50 by removing a group or plurality of each of the fastening elements 38 and 40. Also cuts 52 and 54 are formed in the tapes 34 and 36 to sever the slide fastener chain into lengths corresponding to individual slide fasteners. Further the head portions of several fastening elements 38 and 40 adjacent to the gap 50 at both ends thereof are severed to render installation of a slider easier.

Figure 6:
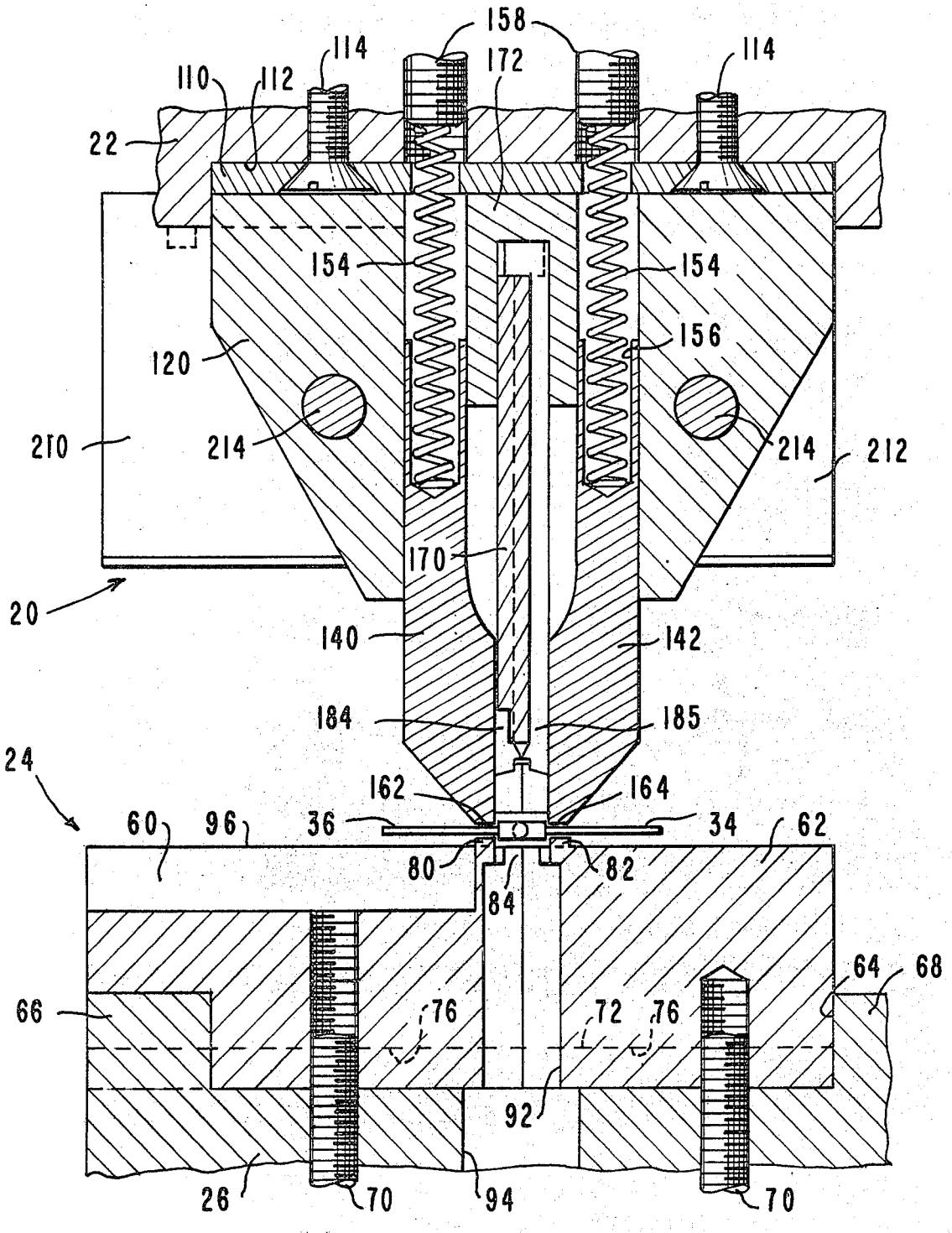
FIG. 6 is a cross-section view taken at line 6—6 in FIG. 1.

As shown in FIGS. 5 and 6, the die arrangement 24 includes a front die member 60 and a rear die member 62 which have the lower portions thereof extending into a channel 64 formed by a front lip 66 and a rear lip 68 of the bolster 26. The die members 60 and 62 are secured to the bolster 26 by bolts 70. A key 72 is secured within a slot 74 extending through the front lip 66. The key 72 extends rearward through slots 76 formed in the bottoms of the die members 60 and 62 for accurately positioning the die members 60 and 62 relative to each other and the lower bolster 26. The key 72 is secured by a screw 78.

A ridge 80 is formed on the upper surface of a rear portion of the front die member 60 while a ridge 82 is formed on the upper surface of the front portion of the rear die member 62; the ridges 80 and 82 defining a channel for receiving and guiding the lower portions of fastening elements 38 and 40 across the die arrangement 24. A vertical die opening 84, formed by cuts in the mating surfaces of the front and rear die members 60 and 62, extends in the surface of the channel between the ridges 80 and 82. The die opening 84 has left and right narrow end portions 86 and 88 for forming element head severing die portions. The central portion of the opening 84 has projections 90 and 91 extending from the respective members 60 and 62 into opposite sides of the opening 84 in staggered relationship so that, as seen in FIG. 11, the projections 90 and 91 underlie heel portions of the respective fastening elements 40 and 38 when the fastening elements are properly positioned over the die opening 84. Thread cutting blade passageways are defined between the projections 90 and 91 on the respective sides of the opening 84. An enlarged opening 92 is formed in the die members 60 and 62 communicating with the bottom of the die opening 84 and extending to a still larger opening 94 through the lower bolster 26 for passing removed fastening elements and severed head portions.

Tape cutting anvil portions are defined on the die members 60 and 62 by a central horizonal surface 96 of the front member 60 and the upper surface of the rear die member 62. The ridges 80 and 82 are ground away across the central portion of the die members 60 and 62 to extend the tape cutting anvil surfaces. The side upper surfaces of the front portion of the front die member 60 are tapered to permit easy access to the slide fastener chain extending across the die arrangement 24.

For cooperating with fastening element positioning facilities of the punch arrangement, the die arrangement 24 has a groove 100 formed in the upper surface of the right portion of the die members 60 and 62. The groove 100 extends perpendicular to the ridges 80 and 82 at the right end thereof. The sides of the grooves 100 define tapered or sloping surfaces. Also the groove 100 defines a ridge 102 at the right edge of the upper surface of the members 60 and 62.

The punch assembly 20, as illustrated in FIGS. 4, 6, 7 and 8 is mounted on the bottom side of the upper bolster 22 and includes a wear plate 110 secured within a channel 112 by screws 114. Left and right punch holders 118 and 120 are secured to the bolster 22 on the lower face of the wear plate 110 by screws 122, the upper portions of the punch holders 118 and 120 extending into the channel 112. A key 124 mounted within a positioning groove 126 in a front lip of the bolster 22 extends rearward into a front portion of a slot 128 formed in the left punch holder 118 for precisely positioning the punch assembly 20 relative to the bolster 22.

The left punch holder 118 has a vertical opening 132 extending through its right central portion wherein front and rear left pressure pads 134 and 136 are slidably mounted, and the right punch holder 120 has a vertical opening 138 extending through its left central portion wherein front and rear right pressure pads 140 and 142 are slidably mounted. Pins 144 mounted in the left punch holder 118 extend into the left side of the opening 132 and into horizonal channels 146 formed in the left sides of the pressure pads 134 and 136, and pins 148 mounted in the right punch holder 120 extend into the right side of the opening 138 within horizonal channels 150 formed in the right sides of the pressure pads 140 and 142 for limiting vertical sliding movement of the pressure pads 134, 136, 140 and 142. Compression springs 154 have their lower ends received within recesses 156 in the upper surfaces of the pressure pads 134, 136, 140 and 142 and extend through openings in the wear plate 110 to pressure adjustment screws 158 mounted in the bolster 22 for biasing the pressure pads 134, 136, 140 and 142 downward. Bottom ridges 162 and 164 are formed on the front and rear pressure pads 134, 136, 140 and 142 vertically aligned with the ridges 80 and 82 on the die members 60 and 62 for cooperating with the ridges 80 and 82 to grip the tapes 36 and 34 of the slide fastener chain on opposite sides of the elements being removed.

Figure 7:
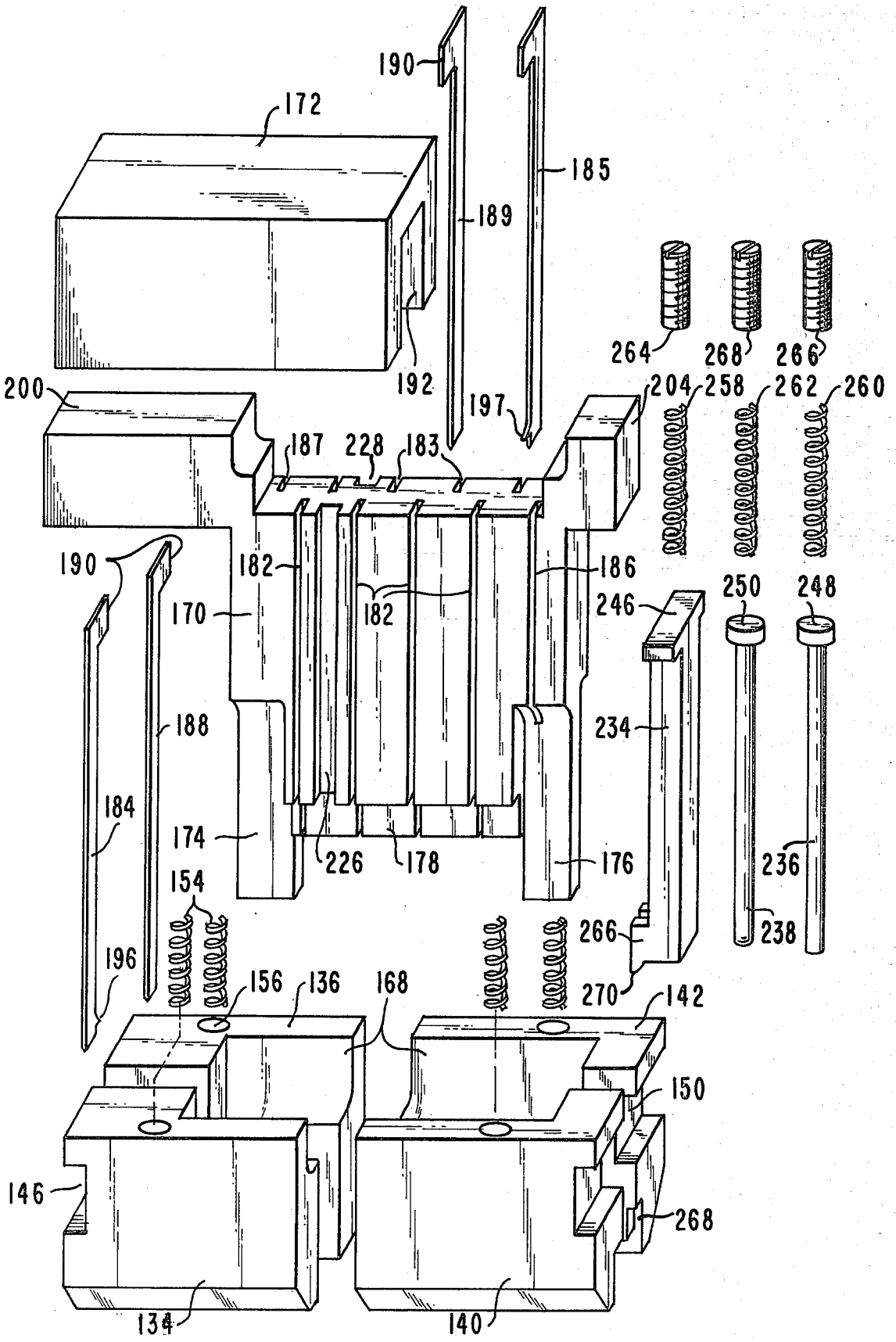
FIG. 7 is an exploded perspective view, as viewed from the upper right front corner, of several inner parts of the upper mechanism portion of FIG. 4.

The pressure pads 134, 136, 140 and 142 are formed with suitable cutouts 168 for extending around the lower portions of a punch 170 and a cutting blade retainer 172. The lower portion of the punch 170 has downward extending fastening element severing punch portions 174 and 176 with reduced thickness on the opposite ends thereof and a lower element removing portion 178 of slightly larger but reduced thickness extending between the punch portions 174 and 176 spaced above the lower ends of the punch portions 174 and 176. Vertical slots 182 and 183 are formed in the front and back of the punch 170 for receiving thread cutting blades 184 and 185 (only one each of pluralities of the blades 184 and 185 are illustrated in FIG. 7). End most slots 186 and 187 are formed in the right front side and left rear side respectively of the punch 170 for receiving respective end most thread cutting blades 188 and 189, respectively. The thread cutting blades 184, 185, 188 and 189 have upper horizonal extensions 190 for engaging the top surface of the central blade holding portion of the punch 170. The blade retainer 172 has a center channel 192 extending through the length thereof for receiving the upper portions of the blades 184, 185, 188, and 189 and to form downward extending front and rear portions extending on opposite sides of the blade holding portion of the punch 170 over the slots 182, 183, 186 and 187 containing the blades 184, 185, 188 and 189 for retaining the blades in the punch 170. The punch 170 has an upper left extension 200 for being engaged in a channel 202 of the left punch holder 118 to secure the assembly of the punch 170, blades 184, 185, 188 and 189 and blade retainer 172 in the punch assembly 20. The extension 200 as well as a shorter right extension 204 are designed so that the upper faces thereof engage the wear plate 110. Sharpened cutting edges 194, FIG. 11, formed on the bottom ends of the blades 184, 185, 188 and 189 are inclined upwardly from the outer edges thereof to prevent the threads 42 and 44 from slipping off of the cutting edges during downward movement of the cutting blades. The cutting blades 184 and 185 differ from the cutting blades 188 and 189 in that the cutting blades 184 and 185 have spurs 196 and 197 formed on the inner edges adjacent the lower ends thereof spaced below the punch portion 178 while the endmost cutting blades 188 and 182 do not have spurs.

Figure 8:
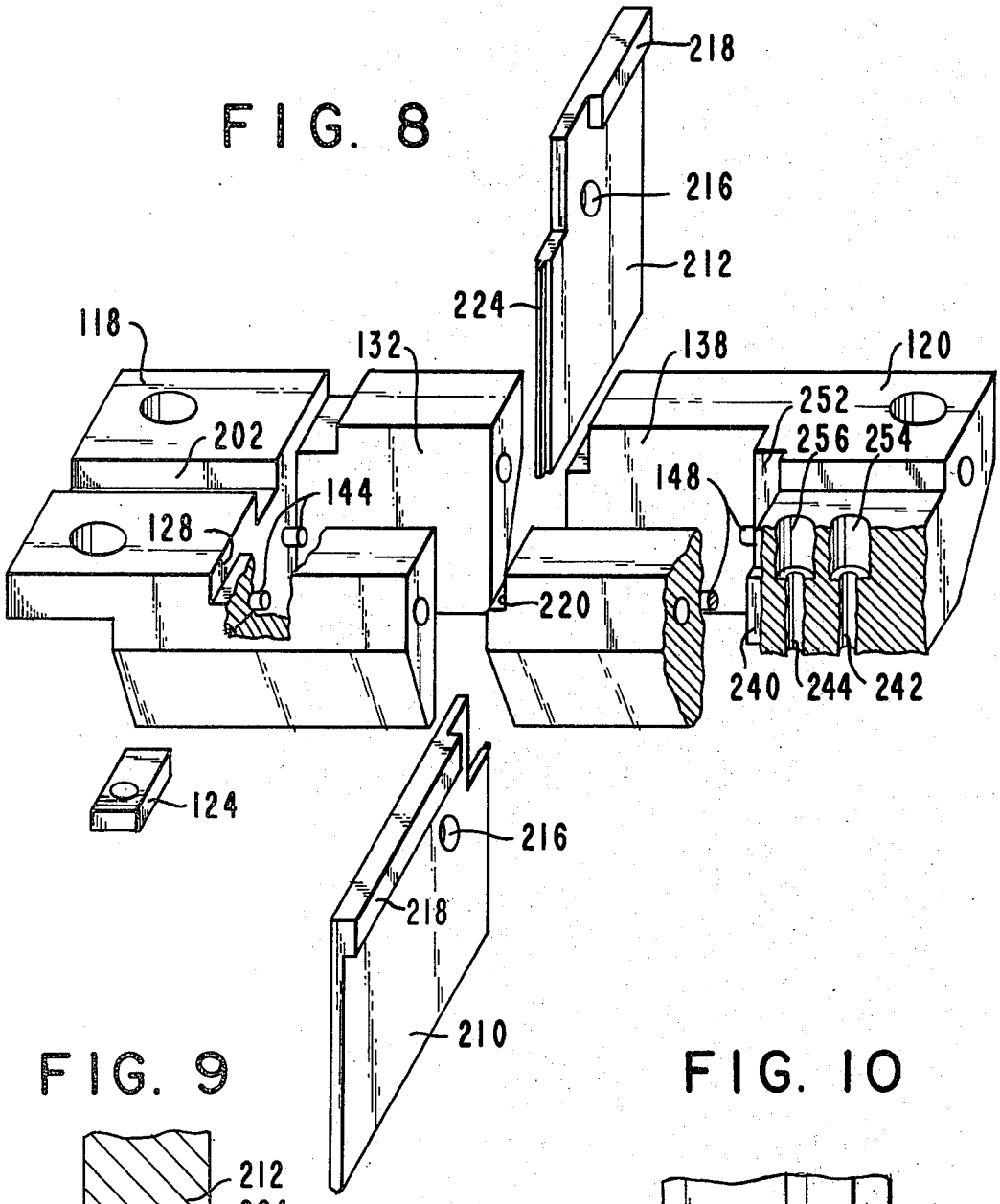
FIG. 8 is an exploded perspective view, partially broken away, as viewed from the upper right front corner of several outer parts of the upper mechanism shown in FIG. 4.
Figure 9:
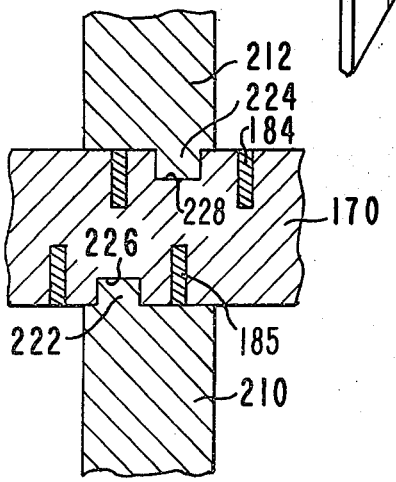
FIG. 9 is a sectional view of the engaging portions of a pair of tape-cutting blades and a connecting-thread cutting-blade holder in the upper mechanism portion of FIGS. 4, 7 and 8.
Figure 10:
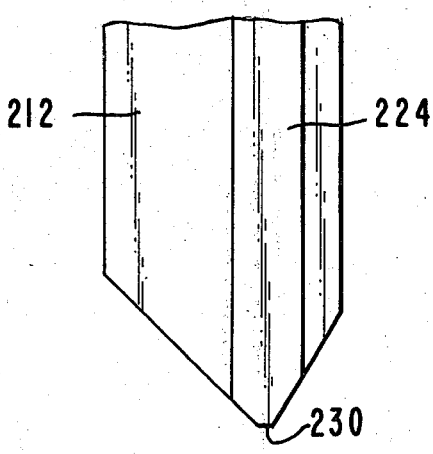
FIG. 10 is an enlarged elevation view of a lower edge portion of a tape-cutting blade of the mechanism portion of FIGS. 4 and 8.

A front tape cutting blade 210 and a rear tape cutting blade 212 as shown in FIGS. 4, 6 and 8 are mounted between the front and rear portions of the right and left punch holders 118 and 120 by bolts 214 which pass through openings 216 in the blades, the bolts 214 also holding the left and right punch holders together. Reinforcing ridges 218 on the cutting blades 210 and 212 are received within notches 220 of the right punch holder 120. The front blade 210 extends between the front pressure pads 134 and 140 while the rear cutting blade 212 extends between the rear pressure pads 136 and 142. As shown in FIG. 9, the cutting blades 210 and 212 have respective narrow ribs 222 and 224 on the inner edges thereof and which are offset from the center planes of the blades. The ribs 222 and 224 are received within vertical slots 226 and 228 on the front and back sides of the punch 170 between thread cutting blades 184 and 185. As shown in FIG. 10 for the blade 212 the cutting edge 230 is offset to be centered with the rib 224 to prevent stress on the rib 224. The cutting edge on the blade 210 is likewise offset but to the opposite side of the center plane of the blade 210 to avoid stress on the rib 222.

Figure 3:
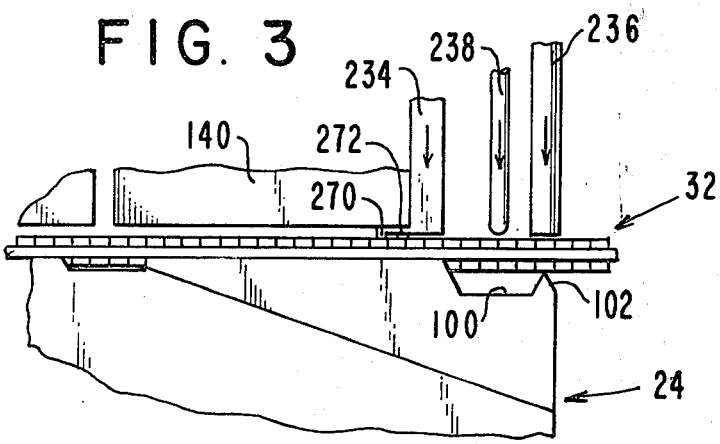
FIG. 3 is an enlarged view of a portion of the mechanism of FIG. 1 for positioning the fastening elements of a slide fastener chain relative to the mechanism.

In order to accurately position the fastening elements of the slide fastener chain 32 relative to the punch and cutting blades, the punch assembly, as shown in FIGS. 3, 4 and 7, includes a scoop locator 234, a chain tension rod 236 and a chain plunger 238. The right punch holder 120, as shown in FIG. 8, has vertical openings 240, 242 and 244 in which the respective locator 234, rod 236 and plunger 238 are slidable retained. The retainer 234 has a head 246, the rod 236 has a head 248 and the plunger 238 has a head 250 which are received in respective enlarged openings 252, 254 and 256 in the upper portion of the punch holder 120; the junction of the enlarged openings 252, 254 and 256 with the respective openings 240, 244 and 242 defining shoulders for engaging the respective heads 246, 248 and 250 to limit downward movement of the locater 234, the rod 236 and the plunger 238. Compression springs 258, 260 and 262 are retained between the heads 246, 248 and 250 and screws 264, 266 and 268 mounted in the upper bolster 22, see FIG. 1, for biasing the respective locater 234, rod 236 and plunger 238 downward. The screws 264, 266 and 268 can be adjusted to adjust the compressive forces on the locater rod, and plunger. The locater 234 has a biforcated lower left portion 266 which extends within a cavity defined by notches 268 in the right pressure pads 140 and 142. Projections 270 and 272 are mounted on the lower surfaces of respective front and rear members of the portion 266 of the locater 234 for engaging into spaces between upper leg portions of the respective fastening elements 40 and 38 to accurately position the elements of the chain 32 relative to the punch and die assemblies 20 and 24. The bottom end of the rod 236 is designed to cooperate with the ridge 102 to grip the slide fastener chain while the plunger 238 is positioned to cooperate with the notch 100 to pull the chain portion extending to the left of the gripping rod 236 and ridge 102 to the right until the locater projections 270 and 272 fall into the spaces between fastening element legs.

In performance of the method of the invention and operation of the mechanism, a continuous slide fastener chain 32 is fed between the punch assembly 20 and die assembly 24 with the fastening elements 38 and 40 restrained by the ridges 80 and 82 to lay within the channel defined thereby. Subsequently the bolster 22 is moved downward to move the punch assembly 20 downward.

As shown in FIG. 3, the chain tension rod 236 first engages the chain 32 to grip the chain between the end of the rod 236 and the ridge 102. The locater projections 270 and 272 engage the top of the fastening element chain and, if the locating projections 270 and 272 are not aligned with spaces between fastening elements, the projections remain on top of the elements. Next the plunger 238 engages the top of the chain and the force of the plunger urges the chain downward into the groove 100. This results in the chain being pulled toward the right underneath the locater 234 until the projections 270 and 272 are aligned with spaces between elements and the locater, under its spring bias, inserts the projections 270 and 272 within the spaces between elements. The chain is now accurately positioned relative to the punch assembly 20. Continued movement of the punch assembly 20 results in the locater 234, rod 236 and plunger 238 raising against their spring bias, and the tapes 36 and 34 of the slide fastener chain being gripped by the ridges 162 and 164 of the pressure pads 134, 136, 140 and 142 and the ridges 80 and 82 on the die members 60 and 62.

As the punch assembly 20 continues to lower, the head severing punch members 174 and 176 cooperate with the narrow end portions 86 and 88 of the die opening 84 to sever the head portions of several elements at the ends of the section of slide fastener chain being gapped.

Figure 12:
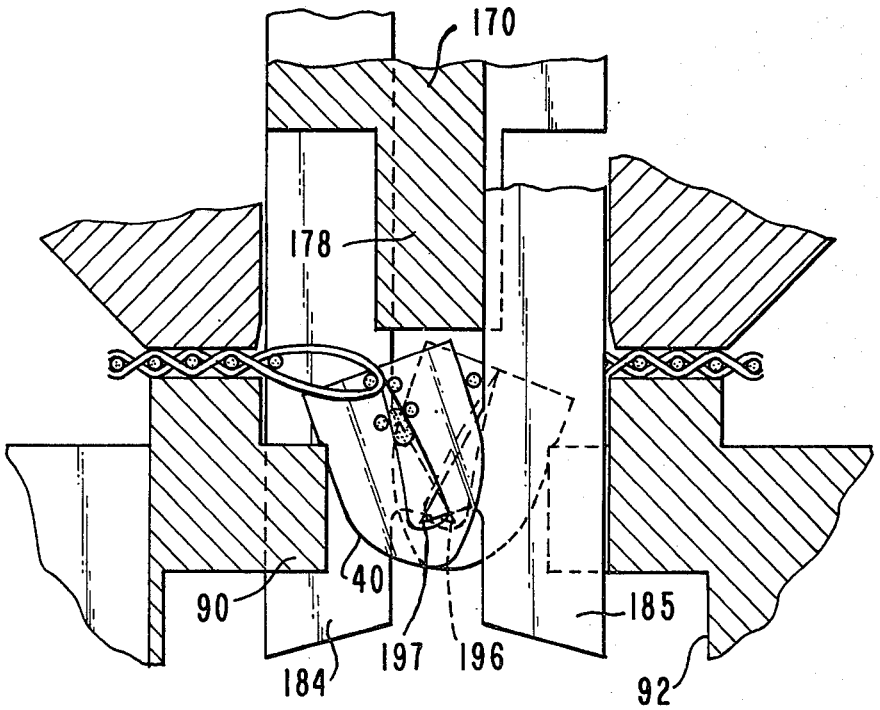
FIG. 12 is a view similar to FIG. 11 but illustrating an element pivoting and removing step.

Referring to FIGS. 11 and 12, the downward movement of the punch assembly results in the cutting edges 194 of the knives 184, 185, 188 and 189 engaging the connecting means on both sides of each of the fastening elements to be removed on each slide fastener stringer. For example the cutting edge 194 engages the connecting threads 42 and the invested cord 44 to sever these threads and cords on the opposite sides of each of the fastening elements 38 and 40 to be removed. Continued downward movement of the blades 184 brings the spurs 196 and 197 into engagement with the heads of the respective fastening elements 38 and 40 to be removed. As shown in FIG. 12, the fastening elements 38 and 40 are rotated or pivoted about the corners of the projections 91 and 90 which results in the pulling of the fastening elements 38 and 40 with the severed stubs of the connecting threads 42 and cord 44 from between the weft loops 46 of the tapes 34 and 36. Continued downward movement results in the elements 38 and 40 being removed to pass into the larger passageway 92. In the event the spurs 196 and 197 slip off of elements, the bottom of the punch 178 engages the pivoted elements to push the elements through the die opening 84 past the projections 90 and 91.

During the last portion of the downward movement of the die assembly, the cutting blades 210 and 212 engage the tapes 34 and 36 of the slide fastener and cooperate with the upper surfaces of the die members 60 and 62 to sever the tapes 34 and 36 at 52 and 54.

After retraction of the die to its upper position, the gapping and severing of the slide fastener chain is completed.

The present method and mechanism for gapping a slide fastener of the type wherein the elements are mounted on longitudinal supporting and connecting means woven in the inner edges of the tapes, produces a gapping with a single movement of a punch. Separate element removing steps are not required. The improvement is made possible by the spurs 196 and 197 mounted on the knife blades 184 and 185 engaging the heads of the elements to produce pivoting of the elements about axes parallel the tapes and outside of the connecting and supporting means and outside the tapes to result in pulling of the severed connecting and supporting means from the weft thread loops. Further the cooperation of the end of the die portion 178 insures that all elements are removed by pushing the elements through the die opening 84 if the spurs should slip off the elements. Further it is noted that the projections 90 and 91 upon retraction of the die assembly will engage the heels of any fastening elements which are hung up on the cutting blades.

Since many variations, modifications and changes in detail can be made to the embodiment described above, it is intended that all matter in the foregoing description and shown in the accompanying drawings be interpreted as illustrative and not in a limiting sense.

What is claimed is:

1. A method of gapping a slide fastener stringer which includes a woven tape, a plurality of spaced fastening elements, and longitudinal connecting and supporting means joined with and extending between the fastening elements, the tape having pluralities of loops of weft thread segments passing around the connecting and supporting means, the method comprising the steps of cutting the connecting and supporting means on opposite sides of each fastening element of a group of fastening elements to be removed, and removing the group of fastening elements and severed ends of the connecting and supporting means from between the loops of weft thread segments, said removing including pivoting the group of fastening elements and severed ends of the connecting and supporting means about an axis extending parallel to the tape and spaced from the tape and the connecting and supporting means.

2. A method as claimed in claim 1 wherein the removing also includes pushing the group of fastening elements after the pivoting.

3. A method of gapping a slide fastener chain which includes a pair of woven tapes, a pair of interlocking rows of spaced fastening elements, and a pair of longitudinal connecting and supporting means joined with and extending between the fastening elements of the respective rows of fastening elements, the tapes each having pluralities of loops of weft thread segments passing around the connecting and supporting means between adjacent elements, the method comprising the steps of cutting the pair of connecting and supporting means on opposite sides of each fastening element of a group of interlocking fastening elements of the pair of rows of fastening elements, the group including a first plurality of fastening elements in one of the pair of rows and a second plurality of fastening elements in the other row, and removing the group of fastening elements and severed ends of the pair of connecting and supporting means from between the loops of weft thread segments, and said removing including pivoting the first and second pluralities of fastening elements and corresponding severed ends of connecting and supporting means about respective pair of axes extending parallel the respective tapes and spaced from the respective tapes and the respective connecting and supporting means, and said pivoting of the respective first and second pluralities of fastening elements being in opposite directions.

4. A method as claimed in claim 3 wherein the removing also includes pushing the respective groups of fastening elements after the pivoting.

5. A method as claimed in claim 3 or 4 wherein the cutting includes engaging a pair of rows of knife blades with the connecting and supporting means to sever the connecting and supporting means, and wherein the pivoting includes engaging spurs on knife blades with opposed fastening elements to pivot the opposed fastening elements.

6. A method as claimed in claim 3 including cutting the pair of tapes of the slide fastener chain.

* * * * *